US005425227A

United States Patent [19]

König

[11] Patent Number: 5,425,227

[45] Date of Patent: Jun. 20, 1995

[54] PROTECTING A TEXTILE PROCESS LIQUID BEFORE APPLICATION TO A FILAMENT

[75] Inventor: Günter König, Uhingen-Baiereck, Germany

[73] Assignee: Zinser Textilmaschinen GmbH, Ebersbach/Fils, Germany

[21] Appl. No.: 35,444

[22] Filed: Mar. 23, 1993

Related U.S. Application Data

[63] Continuation-in-part of Ser. No. 710,530, Jun. 4, 1991, abandoned.

[30] Foreign Application Priority Data

Jun. 29, 1990 [DE] Germany ..... 40 20 890.7

[51] Int. Cl.[6] ..... D01H 13/30; D02G 3/36

[52] U.S. Cl. ..... 57/296; 28/220; 57/75; 57/295; 68/200

[58] Field of Search ..... 57/298, 295, 296, 297, 57/75; 427/424; 28/246, 220; 68/200

[56] References Cited

U.S. PATENT DOCUMENTS

| | | | |
|---|---|---|---|
| 1,964,658 | 6/1934 | Bongrand et al. | 57/297 |
| 2,080,193 | 5/1937 | Bakker | 57/295 |
| 2,781,021 | 2/1957 | Schmitz | 68/200 |
| 3,028,257 | 4/1962 | Svrchek et al. | 427/224 |
| 3,233,585 | 2/1966 | Majette | 68/200 |
| 3,429,113 | 2/1969 | Nimtz et al. | 57/296 X |
| 3,955,254 | 5/1976 | Delarue et al. | 68/200 X |
| 3,983,723 | 10/1976 | Ameling | 68/5 E |
| 4,051,651 | 10/1977 | Wahlen et al. | 57/296 |
| 4,052,521 | 10/1977 | Ferrari | 427/171 X |
| 4,055,937 | 11/1977 | Latus et al. | 57/296 X |
| 4,087,242 | 5/1978 | Frank et al. | 28/220 X |
| 4,165,623 | 8/1979 | Negola et al. | 68/200 X |
| 4,397,913 | 8/1983 | Fahey | 57/295 |
| 4,470,252 | 9/1984 | Brodmann | 57/295 X |
| 4,487,157 | 12/1984 | Bergeron et al. | 427/424 |
| 4,532,154 | 7/1985 | Hartemann | 57/297 X |
| 4,746,565 | 5/1988 | Bafford et al. | 427/407.3 X |

FOREIGN PATENT DOCUMENTS

| | | | |
|---|---|---|---|
| 480762 | 7/1929 | Germany | 68/200 |
| 3003389 | 1/1980 | Germany . | |
| 2072054 | 9/1991 | United Kingdom . | |

*Primary Examiner*—Daniel P. Stodola
*Assistant Examiner*—William Stryjewski
*Attorney, Agent, or Firm*—Herbert Dubno; Andrew Wilford

[57] ABSTRACT

In a textile-processing operation wherein a filament is displaced longitudinally continuously past a treatment station and a liquid is applied to the moving filament at the station, a supply of the liquid is held in a container spaced from the station and connected via a conduit to an applicator at the station. Space above the liquid in the container is filled with a gas that is devoid of free oxygen and that is in direct contact with the liquid. This gas above the liquid is pressurized in the container to controlledly force the liquid from the container through the conduit to the applicator at the station. The liquid is kept out of contact with oxygen until it actually has been applied to the filament. In fact the filament is passed over a small-diameter orifice formed in a guide and the liquid is forced from the orifice. The filament directly engages the guide at the orifice and covers the orifice so that the liquid does not contact the ambient air until after it is applied to the filament.

4 Claims, 2 Drawing Sheets

PROTECTING A TEXTILE PROCESS LIQUID BEFORE APPLICATION TO A FILAMENT

CROSS REFERENCE TO RELATED APPLICATION

This application is a continuation-in-part of patent application Ser. No. 07/710,530 (now abandoned) filed 04 Jun. 1991 with a claim to the priority of German patent application P 4,020,890 filed 29 Jun. 1990.

FIELD OF THE INVENTION

The present invention relates to a textile process. More particularly this invention concerns a method of protecting a liquid used in such a process.

BACKGROUND OF THE INVENTION

In many textile processes, for instance spinning and drawing, it is necessary to apply to a filament a process liquid that degrades rapidly when exposed to free oxygen or that can support bacterial life. Hence it is necessary in such processes to clean the equipment frequently and to work with small supplies of the processing liquid in order to ensure that it is used up before it spoils.

OBJECTS OF THE INVENTION

It is therefore an object of the present invention to provide an improved textile-processing method that avoids such spoiling of the process liquid.

Another object is the provision of such an improved textile-processing method which overcomes the above-given disadvantages, that is which allows a relatively large quantity to be used over a relatively long time without spoiling.

SUMMARY OF THE INVENTION

In a textile-processing operation wherein a filament is displaced longitudinally continuously past a treatment station and a liquid is applied to the moving filament at the station, a supply of the liquid is held in a container spaced from the station and connected via a conduit to an applicator at the station. Space above the liquid in the container is filled with a gas that is devoid of free oxygen and that is in direct contact with the liquid. This gas above the liquid is pressurized in the container to controlledly force the liquid from the container through the conduit to the applicator at the station.

Thus the liquid is kept out of contact with oxygen until it actually has been applied to the filament. In fact according to this invention the filament is passed over a small-diameter orifice formed in a guide and the liquid is forced from the orifice. The filament directly engages the guide at the orifice and covers the orifice so that the liquid does not contact the ambient air until after it is applied to the filament.

The gas according to the invention can be carbon dioxide or an inert gas. The pressure of the gas can be varied in the container.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
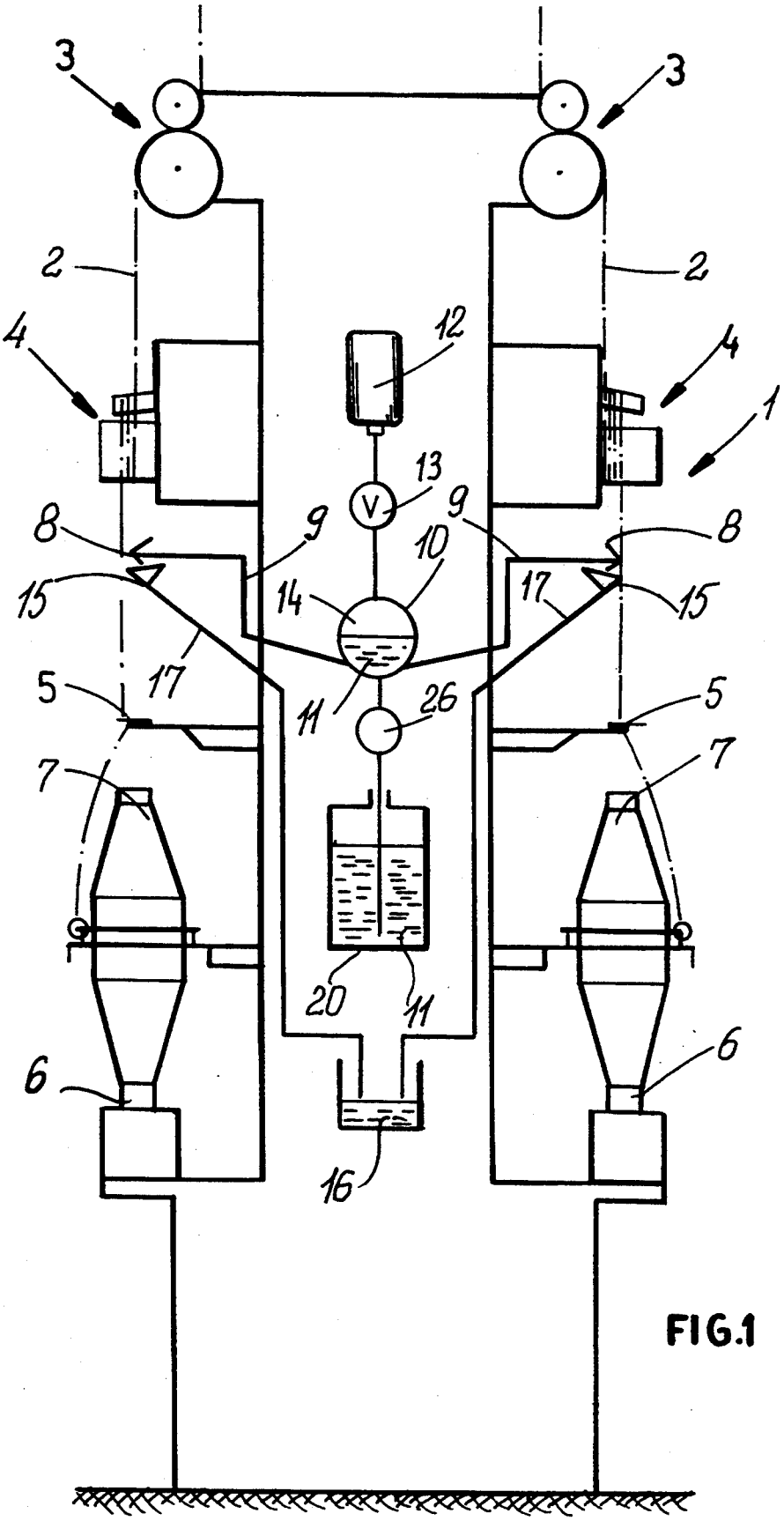
FIG. 1 is a largely schematic diagram illustrating the method and apparatus of this invention.

As seen in FIG. 1 a drafting/spinning machine 1 has a pair of textile filaments 2 that are each fed in through input pinch rolls 3 to a feeder 4 whence it passes through a guide eye 5 to a rotating core 6 where it is wound up as a yarn package 7. This equipment is all standard.

Juxtaposed with each filament 2 between the feeder 4 and the eye 5 is a liquid .applicator 8 connected via a conduit 9 to a bottle 10 holding a supply 11 of the liquid to be applied by the applicators 8 to the filaments 2. This container 10 is kept full by a pump 26 drawing more of the liquid 11 out of a big supply container 20. The liquid 11 can be sizing or a lubricant.

According to the invention the container 10 is pressurized above the liquid 11 with a head 14 of a gas delivered from a gas supply 12 through a pressure-regulating valve 13. This gas can be a relatively inert gas, for instance nitrogen, or a gas devoid of free oxygen, for instance carbon dioxide, or can contain a bactericide, for instance ethylene. Excess liquid is caught at 15 and channeled off via conduits 17 to a catch vessel 16.

Thus with the arrangement of the present invention the liquid 11 is protected against oxidation and/or bacteria growth.

Figure 2:
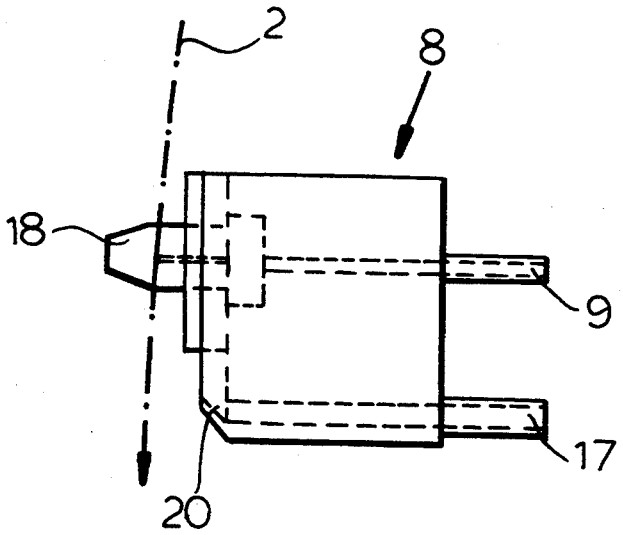
FIG. 2 is a large-scale view of the liquid applicator according to the invention.
Figure 3:
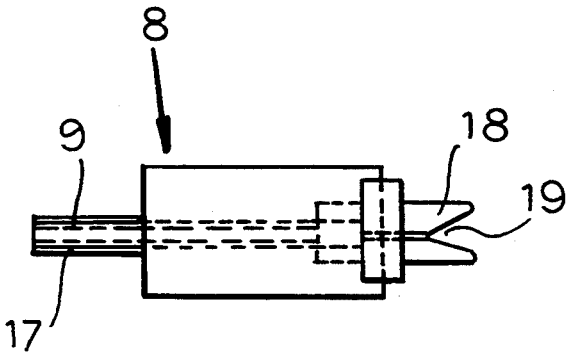
FIG. 3 is a top view of the applicator of FIG. 2.

FIGS. 2 and 3 illustrate the applicator according to the invention. It has a hard ceramic guide 18 forming a V-groove 19 into the base of which opens a tiny orifice (less than 1 mm in diameter) at the downstream end of the conduit 9. The process liquid is therefore applied directly to the filament 2 in very small quantities as it moves continuously at relatively high speed through the applicator. The application rate is less than 1%, that is 1 g of process liquid for 10,000 m of filament weighing 100 g. The process liquid is about 95% water and contains at most 0.05% oil. Any excess liquid is caught at 20 and conducted away via the conduit 17. This type of applicator is described in German patent document 3,003,389.

I claim:

1. In a textile-processing operation wherein a filament is displaced longitudinally continuously past a treatment station and a liquid is applied to the moving filament at the station, a method comprising the steps of:

passing the filament at the station across a small-diameter orifice formed in a guide with the filament in direct contact with the guide at the orifice and with the filament substantially completely covering the orifice;

holding a supply of the liquid in a container spaced from the station and connected via a conduit to the orifice at the station;

filling space above the liquid in the container with a gas that is devoid of free oxygen and that is in direct contact with the liquid; and pressurizing the gas above the liquid in the container and thereby controlledly forcing the liquid from the container through the conduit and from the orifice at the station, whereby the filament is wetted by the liquid as it passes across the orifice from which the liquid is forced and the liquid does not contact the ambient air until after it is applied to the filament.

2. The method defined in claim 1 wherein the gas is carbon dioxide.

3. The method defined in claim 1 wherein the gas is an inert gas.

4. The method defined in claim 1, further comprising the step of varying the pressure of the gas in the container.

* * * * *